US007992251B2

(12) United States Patent
Chung et al.

(10) Patent No.: US 7,992,251 B2
(45) Date of Patent: Aug. 9, 2011

(54) ROBOT AND METHOD FOR CONTROLLING THE ROBOT

(75) Inventors: Moon Kee Chung, Seoul (KR); Jong Il Park, Seoul (KR); Ho Seon Rew, Seoul (KR); Young Gyu Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/528,870

(22) PCT Filed: Feb. 27, 2008

(86) PCT No.: PCT/KR2008/001144

§ 371 (c)(1),
(2), (4) Date: Jan. 27, 2010

(87) PCT Pub. No.: WO2008/105634

PCT Pub. Date: Sep. 4, 2008

(65) Prior Publication Data

US 2010/0133022 A1 Jun. 3, 2010

(30) Foreign Application Priority Data

Feb. 28, 2007 (KR) ..... 10-2007-0020415

(51) Int. Cl.
*A47L 5/00* (2006.01)

(52) U.S. Cl. ..... 15/319; 15/339

(58) Field of Classification Search ..... 15/319, 15/339, 340.1, 49.1, 325; 901/1, 2, 46, 47, 901/49; 700/245, 255, 258; 701/41, 300, 701/301

See application file for complete search history.

(56) References Cited

U.S. PATENT DOCUMENTS

| | | | | |
|---|---|---|---|---|
| 7,155,308 | B2 * | 12/2006 | Jones | 700/245 |
| 7,441,298 | B2 * | 10/2008 | Svendsen et al. | 15/49.1 |
| 7,474,941 | B2 * | 1/2009 | Kim et al. | 700/258 |
| 7,581,282 | B2 * | 9/2009 | Woo | 15/319 |
| 7,647,144 | B2 * | 1/2010 | Haegermarck | 701/23 |
| 2004/0143930 | A1 | 7/2004 | Haegermarck | |
| 2005/0015912 | A1 * | 1/2005 | Kim | 15/319 |
| 2005/0217061 | A1 | 10/2005 | Reindle | |
| 2006/0260090 | A1 | 11/2006 | Kim | |

FOREIGN PATENT DOCUMENTS

WO WO 2005/077240 8/2005

OTHER PUBLICATIONS

International Search Report dated Jun. 30, 2008.

* cited by examiner

*Primary Examiner* — Dung Van Nguyen
(74) *Attorney, Agent, or Firm* — KED & Associates LLP

(57) ABSTRACT

A robot includes a second bumper that senses an obstacle having such a height that can be passed over. Thus, the robot can pass over the obstacle without avoiding it.

26 Claims, 12 Drawing Sheets

[Fig. 1]
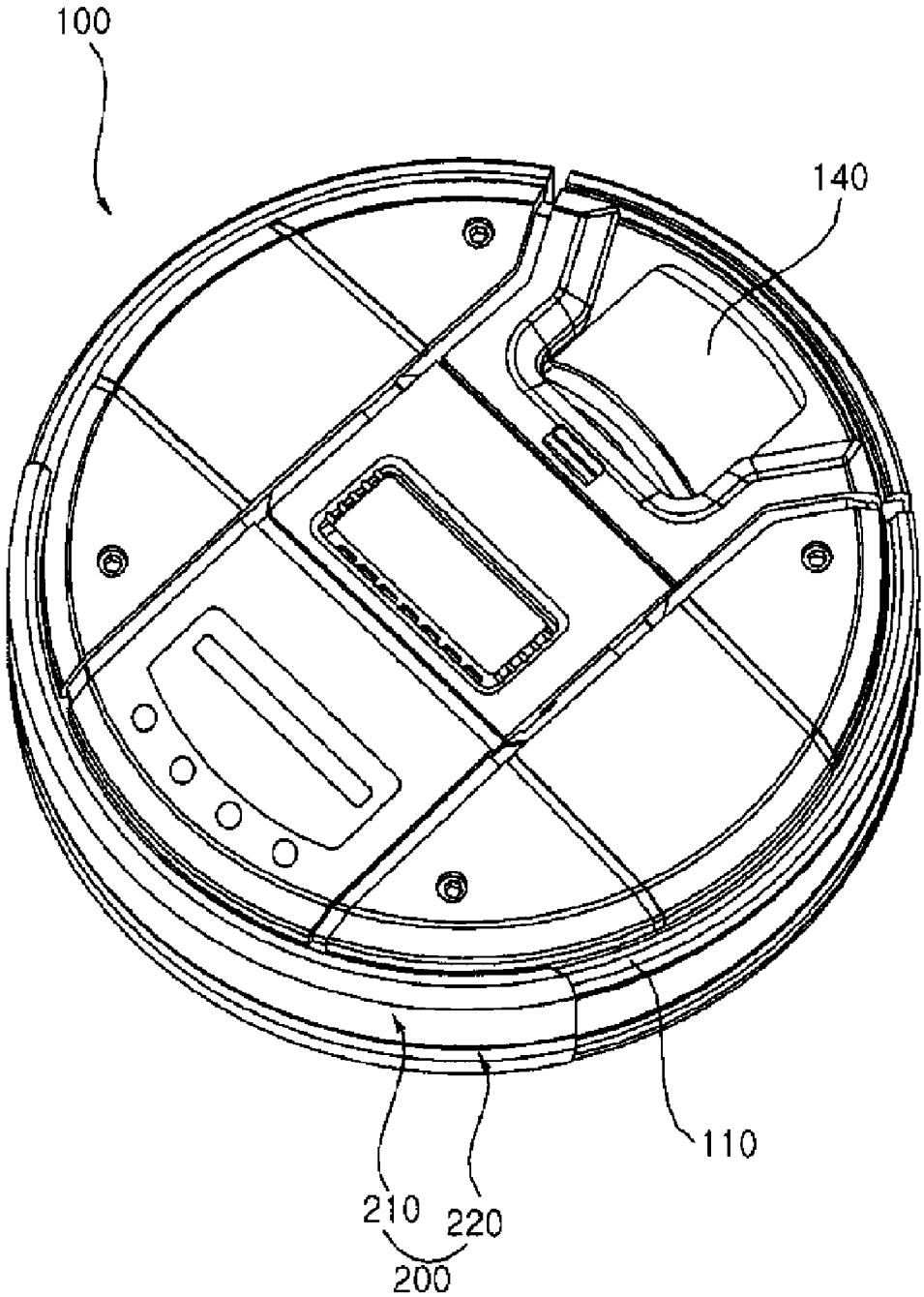

[Fig. 2]
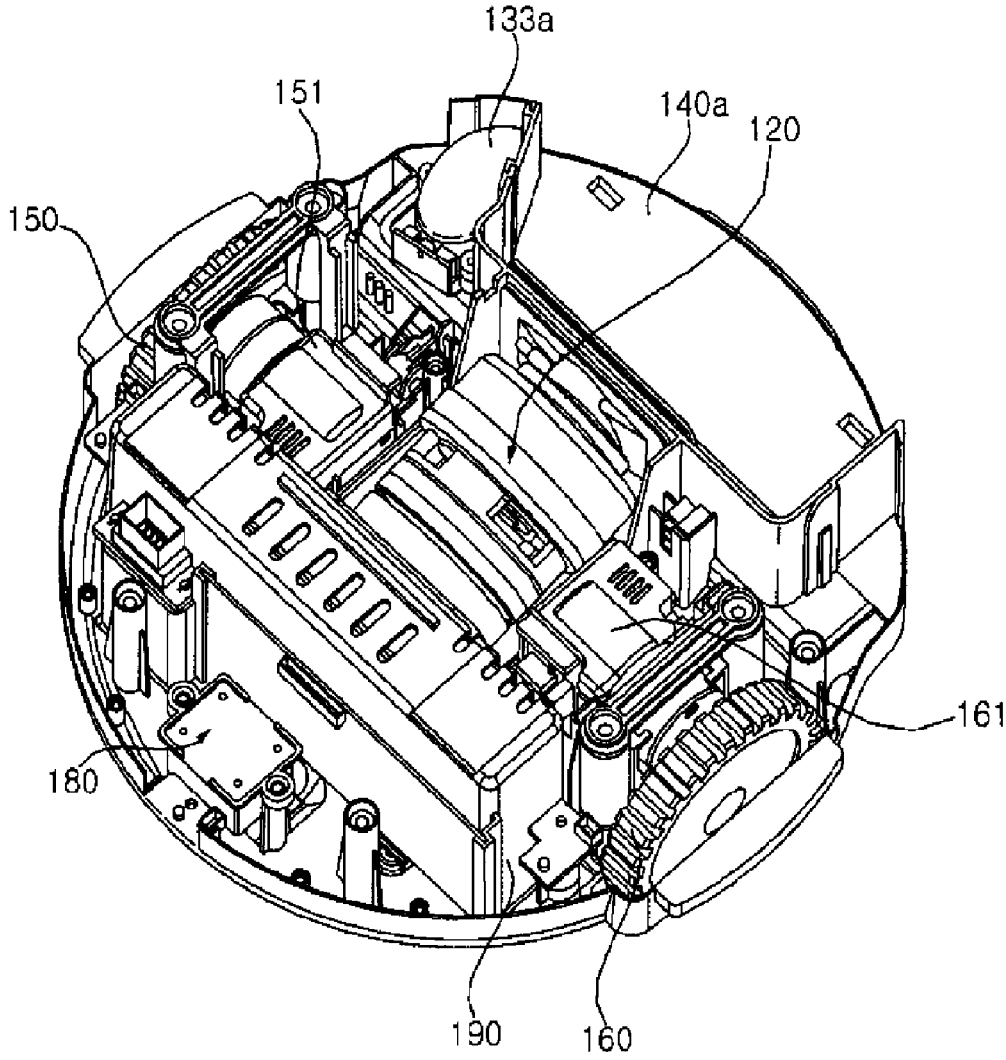

[Fig. 3]
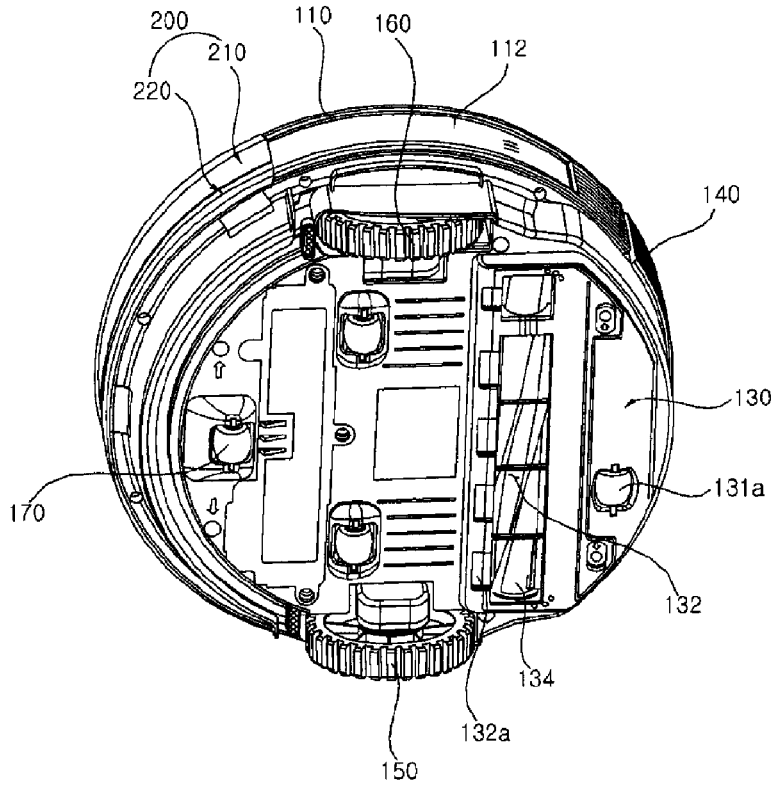
[Fig. 4]
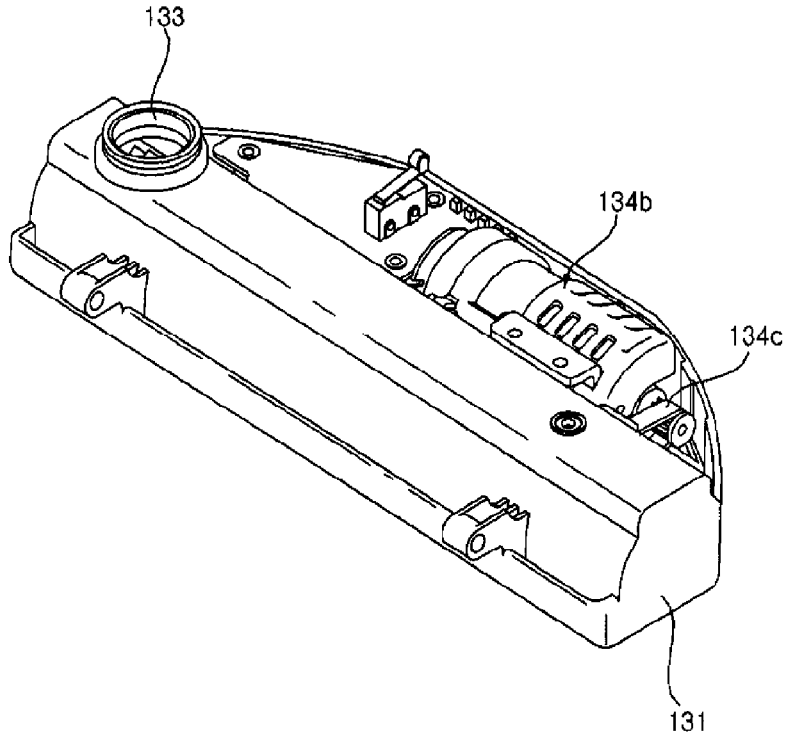

[Fig. 5]
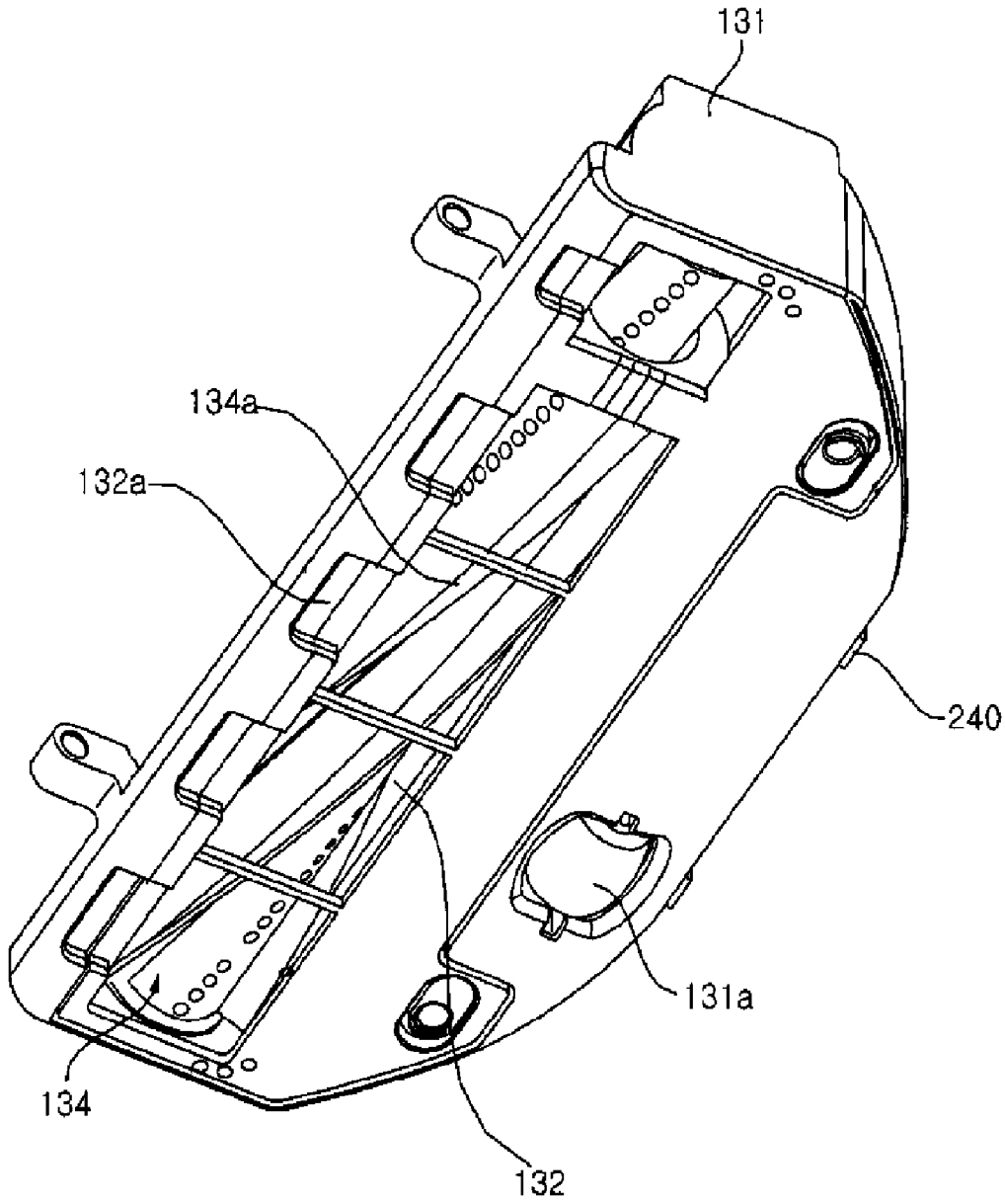

[Fig. 6]
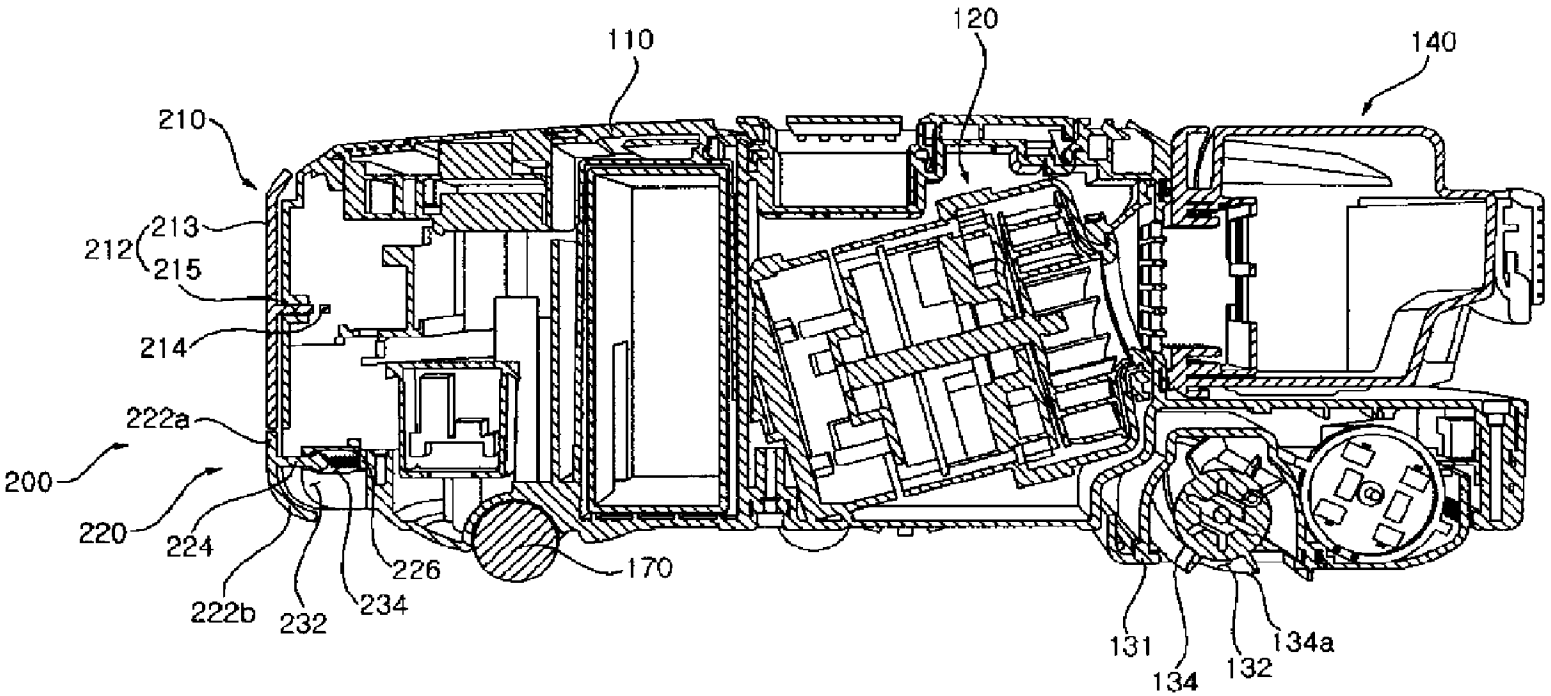

[Fig. 7]
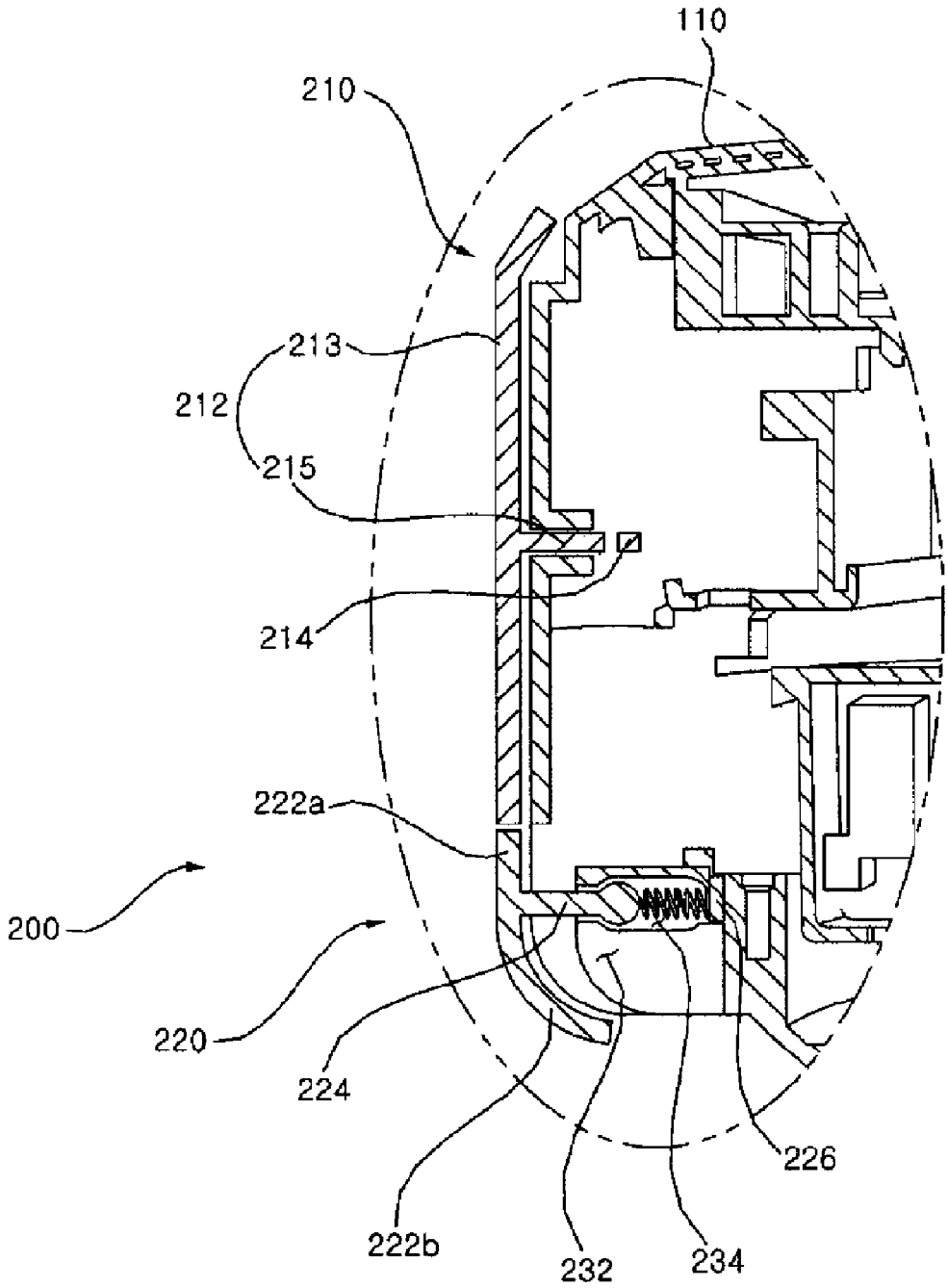

[Fig. 8]
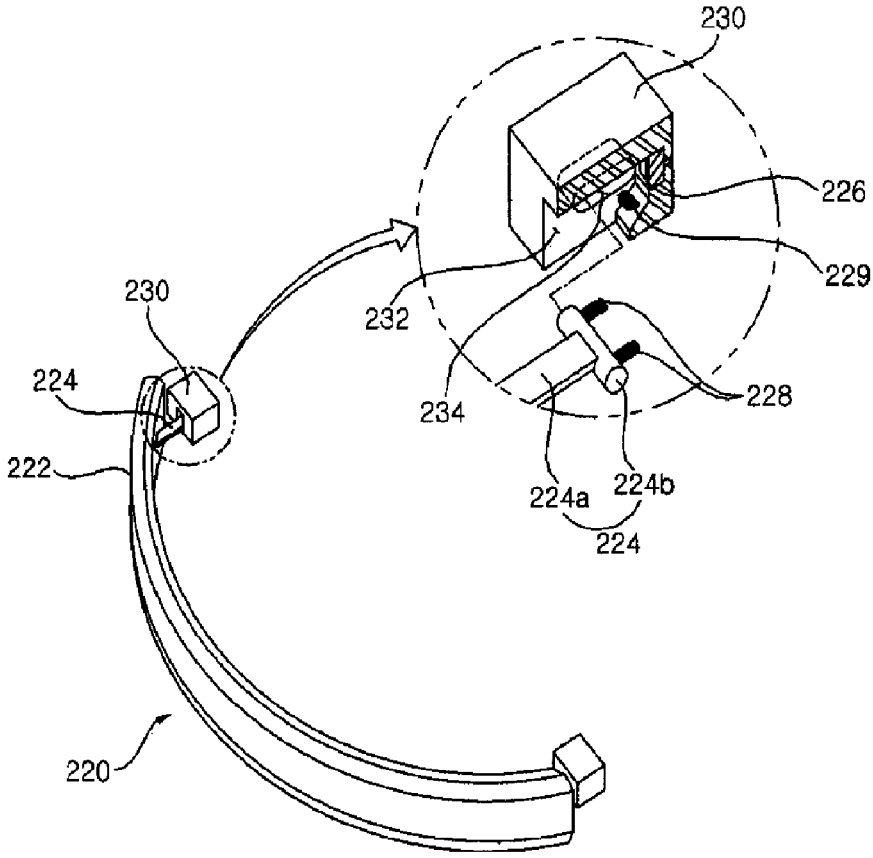
[Fig. 9]
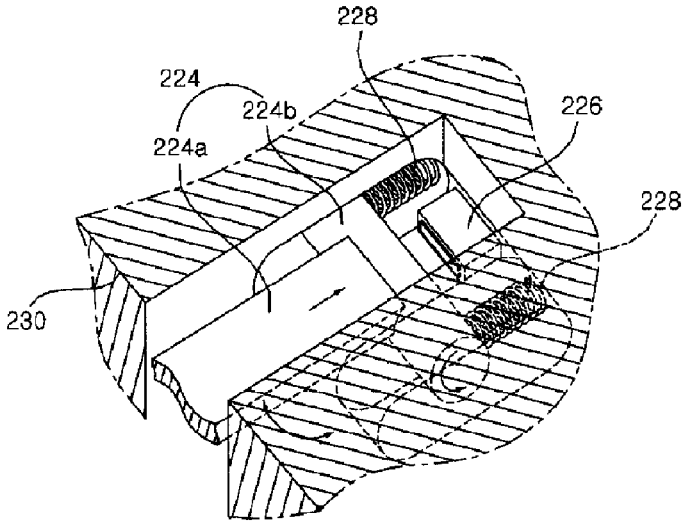

[Fig. 10]
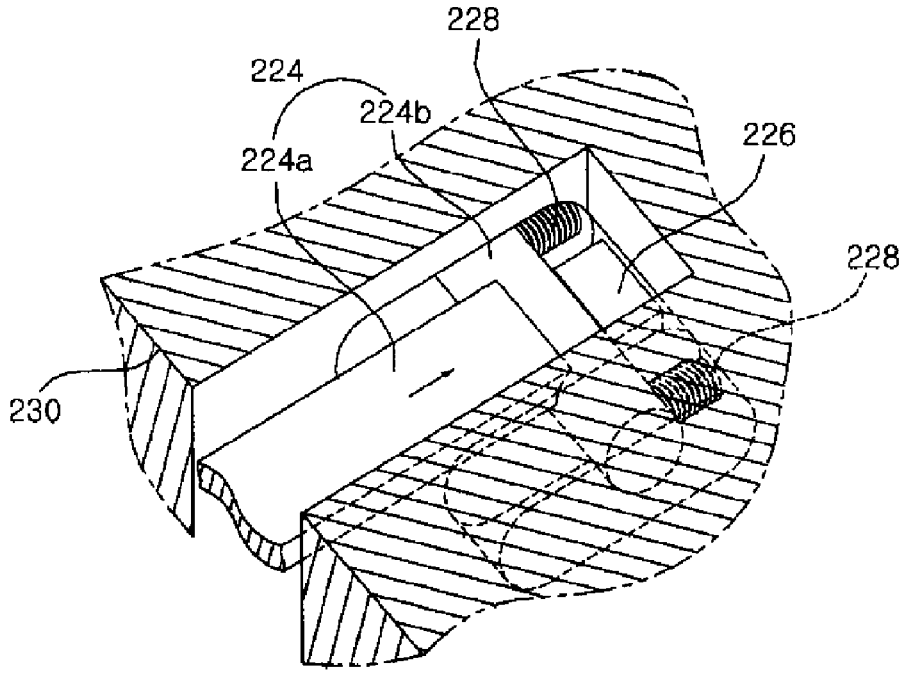
[Fig. 11]
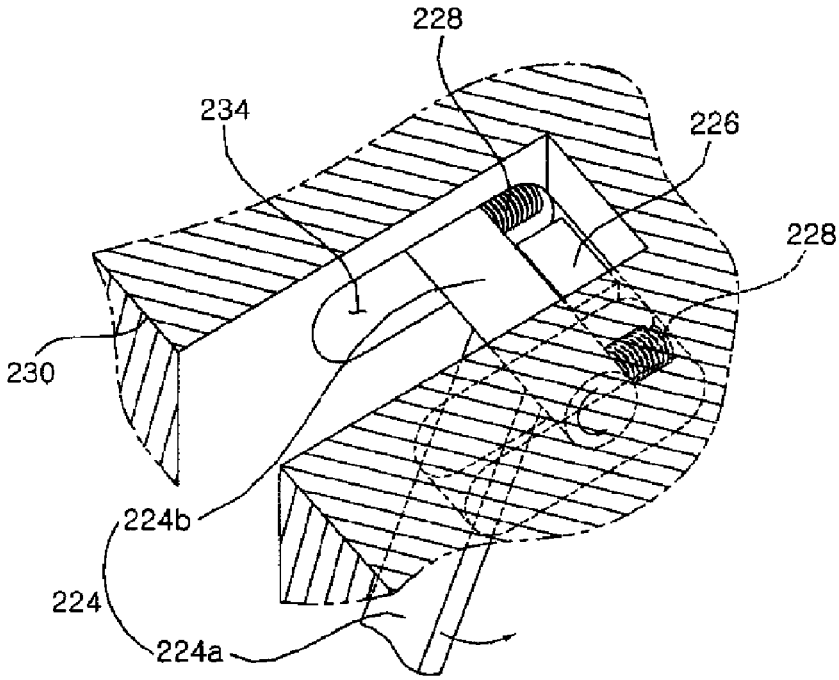

[Fig. 12]
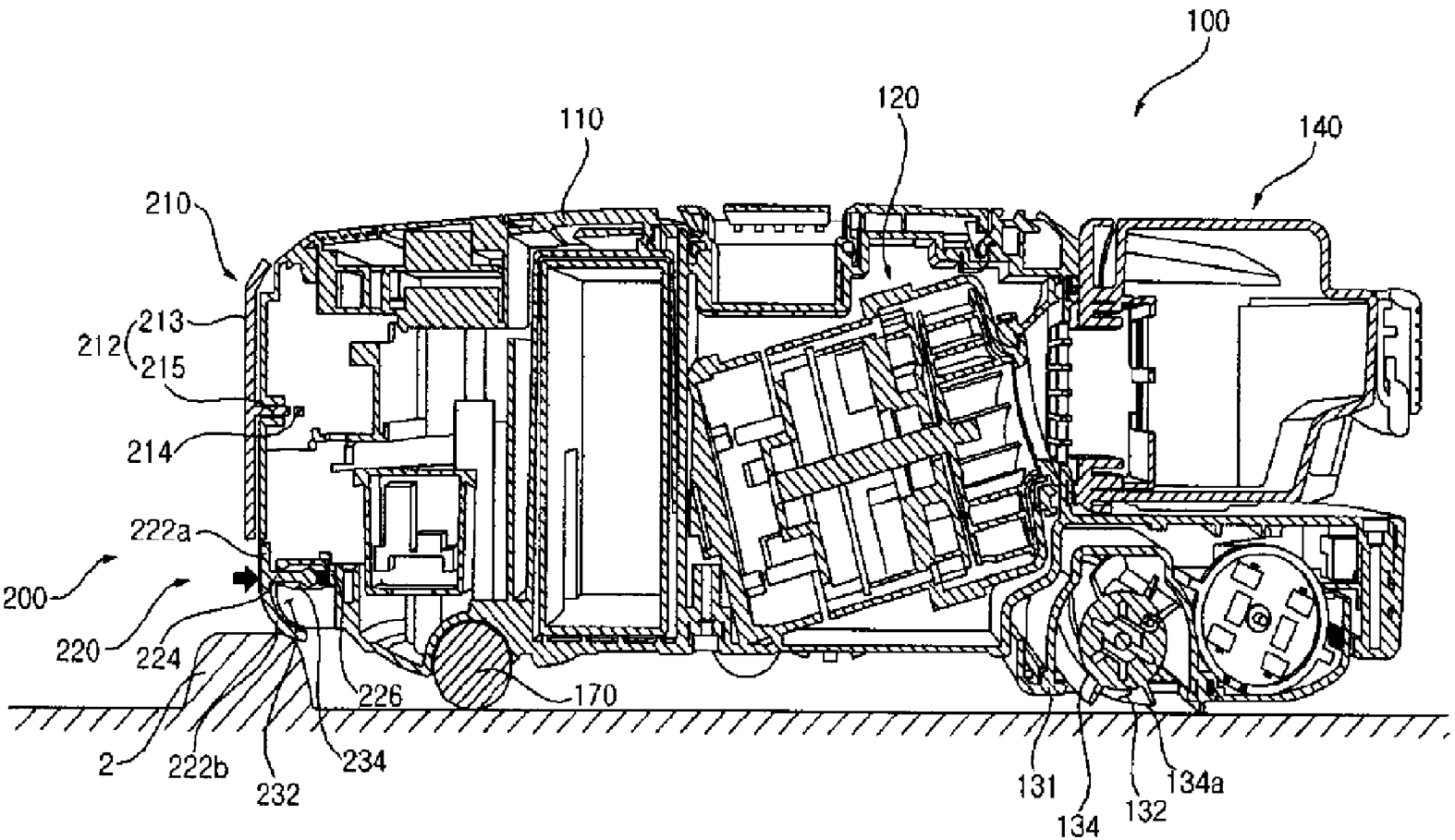

[Fig. 13]
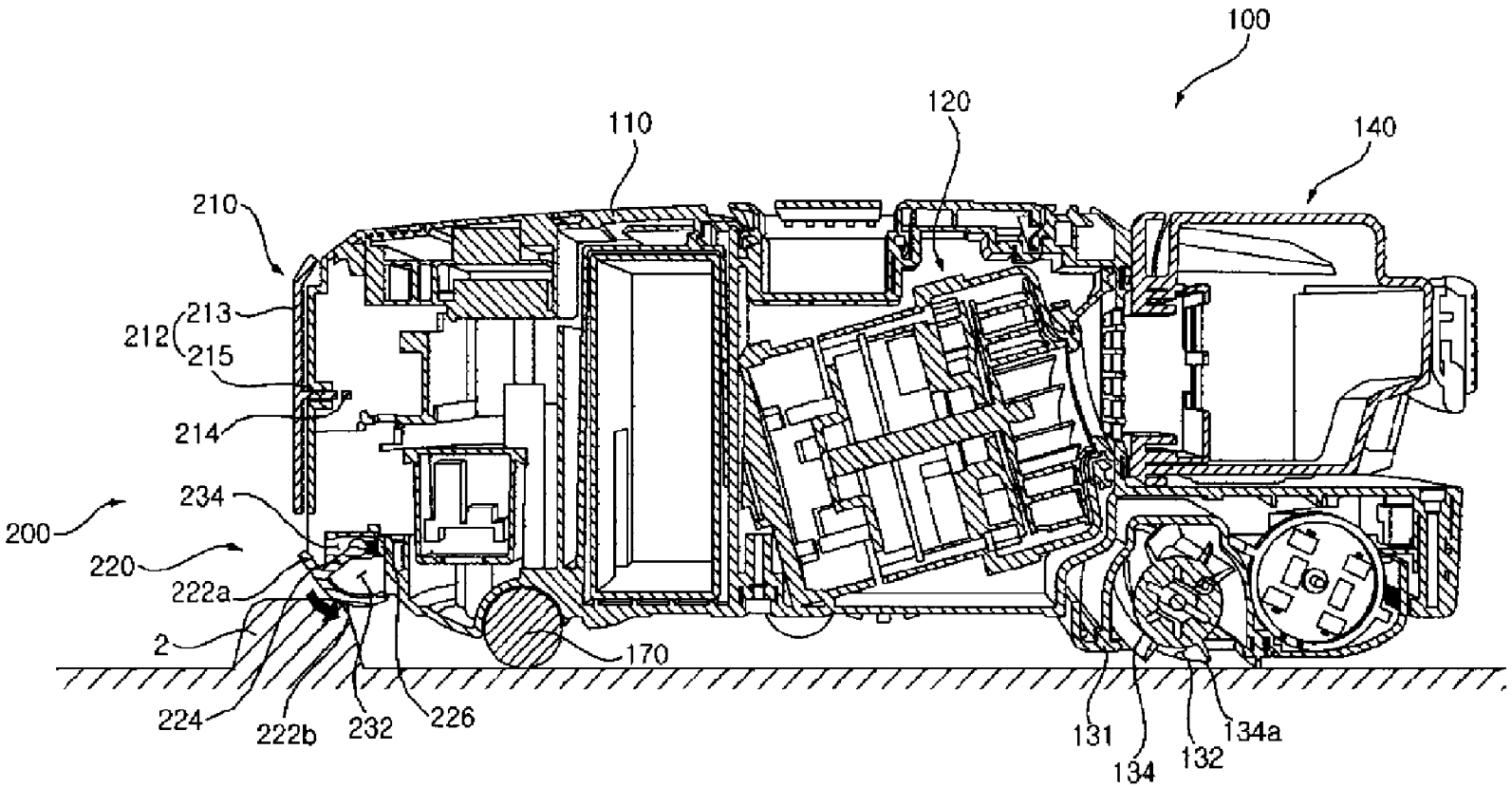

[Fig. 14]
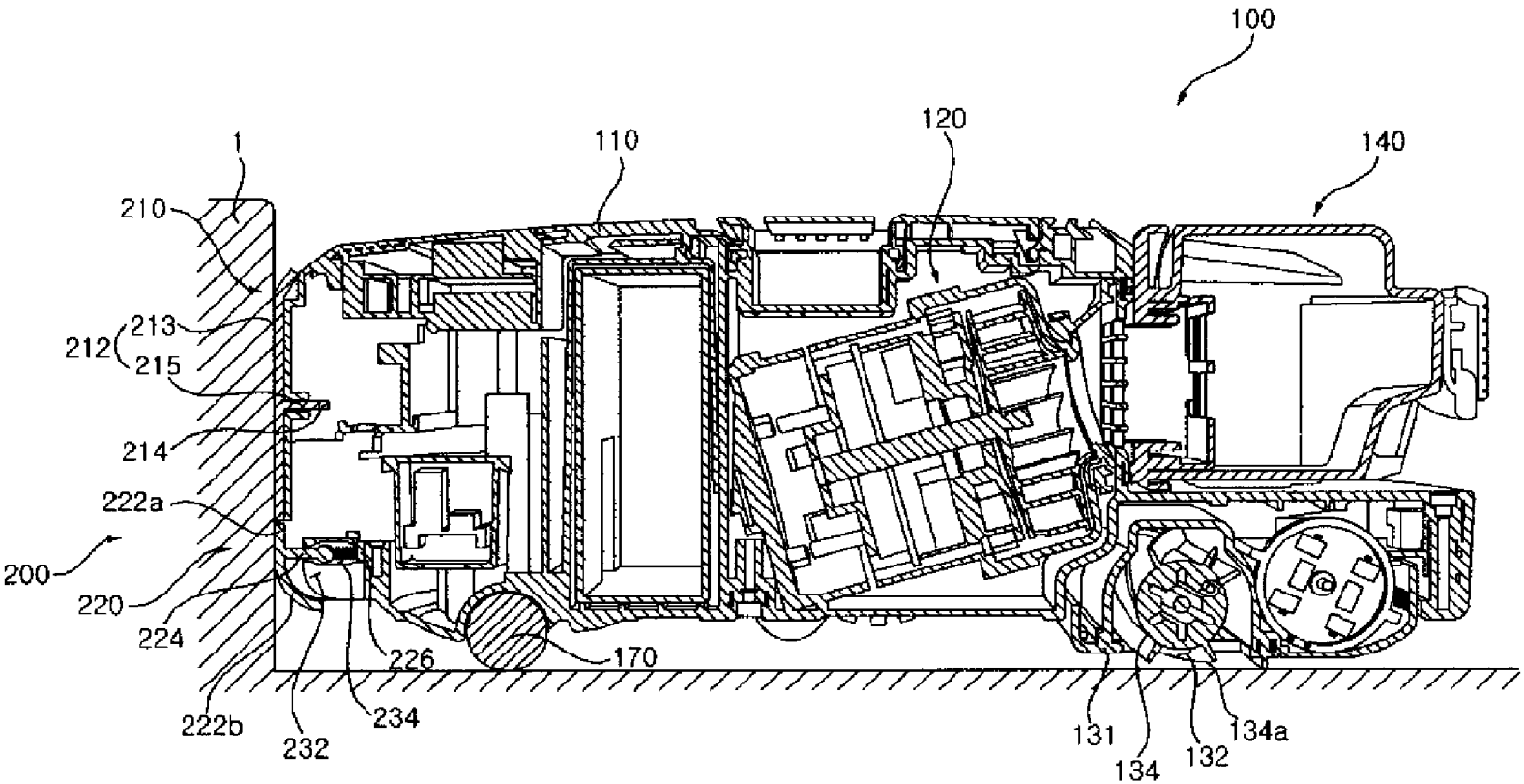

[Fig. 15]
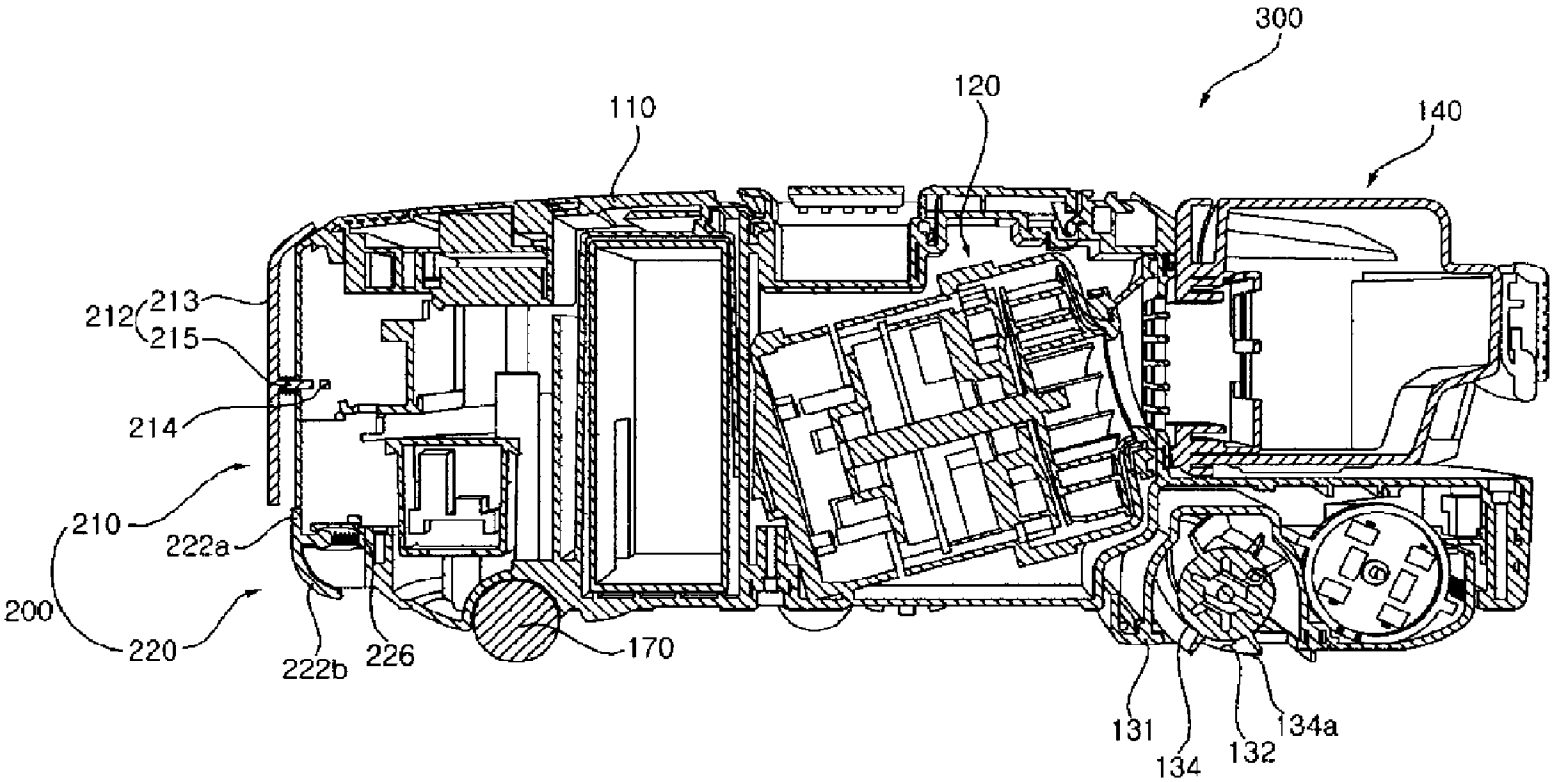

ROBOT AND METHOD FOR CONTROLLING THE ROBOT

TECHNICAL FIELD

The present invention relates to a robot and a method for controlling the robot, and more particularly, to a robot capable of discriminating an obstacle that can be passed over (or surmountable) and a method for controlling the robot.

BACKGROUND ART

A robot cleaner, a sort of a mobile robot, sucks dust or debris while traveling by itself in a space such as in a house or in an office. The robot cleaner includes a sensor that senses an obstacle. The sensor, however, cannot discriminate the size or height of an obstacle in front of it. Thus, even when an obstacle that the robot cleaner can sufficiently pass over is sensed, the robot cleaner makes a detour to avoid the obstacle during its traveling.

DISCLOSURE OF INVENTION

Technical Problem

Thus, an object of the present invention is to provide a robot having a second bumper capable of sensing an obstacle that can be passed over and effectively passing it over, and a method for controlling the robot.

Technical Solution

To achieve the above object, there is provided a robot including: a case; a first bumper that is coupled to the case, and that is configured to sense an obstacle to be avoided; and a second bumper that is configured to sense a surmountable over which the robot is configured to pass.

To achieve the above object, there is also provided a robot including: a case; a first bumper that is coupled to the case, wherein the first bumper is provided at a different height than that of the first bumper, wherein the second bumper is configured to sense an obstacle by contacting the obstacle, wherein an obstacle to be avoided and an obstacle to be passed over are determined based upon obstacle signals sensed by the first and second bumpers.

To achieve the above object, there is also provided a method for controlling a robot, including: providing a case, coupling a first bumper to the case such that the first bumper is configured to sense an obstacle, and providing a second bumper such that the second bumper is configured to sense an obstacle; and determining that the robot is configured to pass over an obstacle when the first bumper does not sense an obstacle signal and the second bumper senses an obstacle signal.

Because the robot according to the present invention includes the second bumper that senses an obstacle having such a height that can be passed over (surmountable), not only does the obstacle that can be passed over be easily discriminated but also the detected obstacle can be passed over without being avoided. In addition, because the robot detects an obstacle to be avoided through the first bumper and discriminates an obstacle that can be passed over through the second bumper, a control operation can be easily performed.

Moreover, when the robot directly contacts with an obstacle to estimate the height of the obstacle, it can certainly discriminate whether the obstacle is to be avoided or to be passed over (surmountable). In this case, when the robot surmounts the obstacle that can be passed over, the second bumper may be relatively rotated in a downward direction of the case. Accordingly, a front end of the robot can be easily lifted, and accordingly, the robot can thus easily pass over the obstacle.

Furthermore, the robot can sense an obstacle, such as a doorsill, that can be passed over, to thus discriminate the border of a room or a living room, through which the robot can sense a cleaning area (i.e., the area to be cleaned).

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a perspective view of a robot according to one embodiment of the present invention.

FIG. 2 is a perspective view showing an inner structure of the robot in FIG. 1.

FIG. 3 is a perspective view showing a lower portion of the robot in FIG. 1.

FIG. 4 is an upper perspective view showing a suction nozzle unit as shown in FIG. 1.

FIG. 5 is a lower perspective view showing the suction nozzle unit in FIG. 1.

FIG. 6 is a sectional view of the robot in FIG. 1.

FIG. 7 is a schematic sectional view showing a bumper unit in FIG. 6.

FIG. 8 is a partial cut-out perspective view of a second bumper in FIG. 7.

FIG. 9 is a perspective view showing the second bumper in FIG. 7.

FIG. 10 is a view showing one example of an operation of the bumper unit in FIG. 7.

FIG. 11 is a view showing another example of the operation of the bumper unit in FIG. 7.

FIGS. 12 and 13 are views showing operational states of the second bumper in FIG. 6.

FIG. 14 is a view showing an example of an operational state of a first bumper in FIG. 6.

FIG. 15 is a sectional view of a bumper unit of a robot according to another embodiment of the present invention.

MODE FOR THE INVENTION

Preferred embodiments of a plasma display apparatus according to the present invention will be described in detail with reference to the accompanying drawings.

With reference to FIGS. 1 to 3, a robot 100 includes a case 110 that makes the external appearance, an air suction device 120 that is installed within the case 110, and sucks air from a lower portion of the case 110 and discharges it to the exterior of the case 110, a suction nozzle unit 130 that is installed at the case 110 and connected with the air suction device 120 to provide a flow path through which external air is sucked, and includes an agitator 134 that agitates dust on the floor, and a dust collecting device 140 that separately collects debris from air sucked from the suction nozzle unit 130.

The case 110 is configured to have a circular disk shape with a certain height. Within the case 110, there are disposed the air suction device 120, the suction nozzle unit 130, and the dust collecting device 140 that communicates with the suction nozzle unit 130. In addition, left and right driving wheels 150 and 160 for moving the robot 100 are installed at lower portions of the both sides of the case 110. The left and right driving wheels 150 and 160 are respectively rotated by a left wheel motor 151 and a right wheel motor 161 which are controlled by a controller 180, and the robot 100 goes straight, goes back, pivots, and rotates. An auxiliary wheel 170 is disposed on the bottom of the case 110 to prevent the lower surface of the case 110 from directly contacting with the floor and minimize frictional contact between the robot 100 and the floor.

The controller 180, which includes various electrical parts for controlling driving of the robot 100, is installed at a front portion of the case 110. In addition, a battery 190, which supplies power to each component of the robot 100, is installed at a rear side of the controller 180. The air suction device 120, which generates an air suction force, is installed at a rear side of the battery 190, and a dust collecting device mounting part 140*a*, which allows the dust collecting device 140 to be mounted thereon, is installed at a rear side of the air suction device 120. The dust collecting device 140 is fixedly caught at the dust collecting device mounting part 140*a* in a mutual manner, and attached to or detached from the rear side thereof.

The suction nozzle unit 130 is disposed at a lower side of the dust collecting device 140. The suction nozzle unit 130 sucks debris along with air from the floor. The air suction device 120 is slantingly installed between the battery 190 and the dust collecting device 140 and includes a motor (not shown) which is electrically connected with the battery 190 and a fan (not shown) which is connected with a rotational shaft of the motor and forces air to flow. The suction nozzle unit 130 is installed to face the bottom of the case 110 to allow a suction opening 132 to be exposed downwardly of the case 110.

With reference to FIGS. 4 to 6, the suction nozzle unit 130 includes a nozzle case 131 having the suction opening 132 and an exhaust hole 133 and installed at the case 110, and the agitator 134 installed at the side of the suction opening 132 within the nozzle case 131 to agitate dust on the floor. The suction opening 132 is formed on the lower surface of the case 110 in a communicating manner to face the floor, and the exhaust hole 133 is formed to communicate with the dust collecting device 140 to guide air sucked through the suction hole 132 to the dust collecting device 140. The auxiliary wheel 131*a* is installed on the lower surface of the nozzle case 131 to prevent the suction hole 132 from being tightly attached to the floor. The suction opening 132 sucks debris accumulated on the floor by an air suction force generated by the air suction device 120, and the exhaust hole 133 is connected with the dust collecting device 140 via a communication vessel 133*a*.

A plurality of suction recesses 132*a* are formed on the lower surface of the nozzle case 131 in a forward/backward proceeding direction of the robot. The suction recesses 132*a* are configured to serve as a passage through which debris on the floor in front of the nozzle case 131 is sucked, and prevent the suction opening 132 from being clogged to thus prevent an overload of the motor provided at the air suction device 120. Both ends of the agitator 134 are rotatably connected at both side walls of the suction opening 132, such that the agitator 134 can be rotated or reciprocally rotated to make dust on the floor or on a carpet brushed up to drift in the air. A plurality of blades 134*a* are formed in a spiral direction on an outer circumferential surface of the agitator 134, and bushes may be installed between the blades 134*a* configured in the spiral form.

In order to operate the agitator 134, the nozzle case 131 includes an agitator motor 134*b* and a belt 134*c* as a power transmission mechanism for transferring power of the agitator motor 134*b* to the agitator 134. Accordingly, when a rotational force of the agitator motor 134*b* is transferred to the agitator 134 via the belt 134*c*, the agitator 134 is rotated to brush up debris from the floor to the suction opening 132.

With reference to FIGS. 6 to 14, the robot 10 includes a bumper unit 200. The bumper unit 200 includes a first bumper 210 and a second bumper 220. The first bumper 210 is disposed on a front portion of the case 110 and senses an obstacle 1 to be avoided upon contacting with it. When the first bumper 210 contacts with the obstacle 1 to be avoided, it serves to absorb the impact while being moved backwardly and sense the obstacle 1 to be avoided. The first bumper 210 includes a bumper plate 212 disposed on the front surface of the case 110 and movable forwardly/backwardly of the robot 100, and a sensor 214 that senses movement of the bumper plate 212. The bumper plate 212 includes a contact portion 213 contacting with the obstacle 1 to be avoided, and a slide portion 215 disposed on the rear surface of the contact portion 213 and inserted to be protruded to the inner side of the case 110. The slide portion 215 is slidably moved in the forward/backward direction of the robot 100 along the case 110. The sensor 214 is disposed within the case 110 and contacts with the slide portion 215 to sense that the first bumper 210 has collided with the obstacle 1 to be avoided. In addition, the sensor 214 transfers an obstacle sense signal of the sensed obstacle to the controller 180.

The second bumper 220 is configured to have a certain height, sense a surmountable obstacle 2 (i.e., the obstacle 2 that can be passed over) having such a height that can be passed over, and pass over the surmountable obstacle 2 when contacting with the surmountable obstacle 2. When the second bumper 220 passes over the surmountable obstacle 2, it is rotated downwardly of the case 110 to pass over the surmountable obstacle 2. The second bumper 220 includes a sensing plate 222 that contacts with the surmountable obstacle 2, an arm 224 configured to be protruded from the sensing plate 222 toward the rear side, a sensor 226 that is disposed within the case 110 and contacts with the arm 224 to sense a signal of the surmountable obstacle 2, and a guide member 230 disposed in the case 110 and guiding a slidable movement and relative rotation of the arm 224.

The sensing plate 222 includes a circumferential portion 222*a* disposed at an edge of an outer portion of the case 110, and a bent portion 222*b* connected with the circumferential portion 222*a* and disposed at a lower portion of the case 110. The arm 224 is configured to be protruded from a rear surface of the sensing plate 222 toward a rear side of the robot 100. The arm 224 includes a rod portion 224*a* formed to extend long toward the guide member 230, and a hinge portion 224*b* that is moved and rotated along the guide member 230. The hinge portion 224*b* is formed to have a cylindrical shape so as to be slidably moved along the guide member 230 and rotated in the guide member 230. The hinge portion 224*b* is perpendicular to the rod portion 224*a* and disposed in a left/right direction of the robot 100.

The sensor 226 is disposed in the guide member 230, generates a signal by being contacted with the hinge portion 224*b*. Various types of sensors may be installed, and in the embodiment of the present invention, a tactile switch type sensor is installed. The guide member 230 is a member for guiding a forward/backward slidable movement and rotation of the arm 224. The guide member 230 includes a rod recess 232 in which the rod portion 224*a* is inserted, and hinge recesses 234 disposed to be perpendicular to the rod recess 232. The hinge recesses 234 are formed at both left and right sides of the rod recess 232, and the hinge portion 224*b* is inserted in the respective hinge recesses 234 and slidably moved in the forward/backward direction and rotated.

The sensor 226 is disposed at a rear end portion of the rod recess 232, and when the rod portion 224*a* is slidably moved to the rear side of the robot 100, the sensor 226 senses the rod portion 224*a*. The guide member 230 may be integrally formed with the case 110, and in the embodiment of the present invention, the guide member 230 is assembled and fixed with the case 110. The arm 224 and the guide member 230 may be installed only at one position at the central portion of the sensing plate 222, and in the embodiment of the present invention, a plurality of arms 224 and guide members 230 are installed at left and right sides of the case 110 in order to more stably guide the slidable movement and relative rotation of the sensing plate 222.

Elastic members 228, which provide an elastic force, are disposed to press the arm 224 forwardly in the guide member 230. The elastic members 228 are disposed in the hinge recesses 234. Thus, when no external force is applied to the arm 224, the arm 224 is positioned at the front side of the case 110, and in case of collision with the obstacle 1 to be avoided or with the surmountable obstacle 2, the arm 224 is slidably moved backwardly while pressing the elastic members 228. A return spring 229 is disposed between the guide member 230 and the arm 224 in order to return the arm 224 to its original position when the arm 224 is relatively rotated. In the embodiment of the present invention, the return spring 229 is disposed at a lower side of the arm 224 to support the arm 224.

The process in which the robot 100 passes over the surmountable obstacle 2 will now be described in detail with reference to FIGS. 12 and 13.

When the robot 100 comes in contact with the surmountable obstacle 2 while traveling, the surmountable obstacle 2 contacts with the second bumper 220 disposed at a lower side, among the first bumper 210 and the second bumper 220. As the surmountable obstacle 2 and the second bumper 220 contact with each other, the sensing plate 222 of the second bumper 220 is moved backwardly due to the impact caused by the contacting and the arm 224 integrally connected with the sensing plate 222 is also moved backwardly. The arm 224 presses the elastic members 228 disposed within the guide member 230 and comes in contact with the sensor 226 disposed in the guide member 230 to generate a signal. The controller 180 determines that the obstacle contacted by the sensing plate 222 is the surmountable obstacle 2 based on the signal transferred from the sensor 226.

Thereafter, the controller 180 operates the driving wheels 150 and 160 to make the case 110 keep moving forward. When the case 110 is continuously moving forward, a driving force of the robot 100 acts on in the state of being contact with the surmountable obstacle 2, according to which the sensing plate 222 is relatively rotated downwardly of the case 110 while supporting the surmountable obstacle 2. The sensing plate 222 is rotated based on the hinge portion 224*b* while being supported at the end portion of the rear side of the hinge recesses 234, and the relative rotation of the sensing plate 222 is caused while the case 110 is moving forward. When the sensing plate 222 is rotated by more than a certain angle, the sensing plate 222 and the surmountable obstacle 2 are slipped owing to the operational force of the driving wheels 150 and 160. As the slip occurs, the sensing plate 222 is due to pass over the surmountable obstacle 2, and at this time, the front end of the case 110 is in a state of being lifted compared with the rear end thereof by the surmountable obstacle 2.

When the driving wheels 150 and 160 are continuously operated, the driving wheels 150 and 160 can pass over the surmountable obstacle 2. The surmountable obstacle 2 may include a doorsill or the like that demarcates rooms. When the contact between the surmountable obstacle 2 and the second bumper 220 is released, the arm 224 is moved forward and relatively rotated to its original position by the elastic members 228 and the return spring 229.

The second bumper 220 can sense the doorsill present in an area to be cleaned by the robot 100, by which it can check the border between a room and a living room or between rooms. In addition, because the robot 100 can move to a space blocked by the surmountable obstacle 2 by simply passing over the surmountable obstacle 2, the cleaning available area can be extended.

The process in which the robot 100 passes over the obstacle 1 to be avoided will now be described in detail with reference to FIG. 14. When the case 110 collides with the obstacle 1 to be avoided, the obstacle 1 to be avoided comes in contact with both the first bumper 210 and the second bumper 220. The sensors 214 and 226 of the first bumper 210 and the second bumper 220 generate an obstacle signal, respectively. Accordingly, the controller 180 senses the signals generated by the sensor 214 and changes a movement direction of the robot 100.

In the embodiment of the present invention, the front of the bumper plate 212 of the first bumper 210 and that of sensing plate 222 of the second bumper 220 are configured to come on the same line, according to which when the obstacle 1 to be avoided contacts therewith, the bumper plate 212 and the sensing plate 222 are simultaneously operated, and the obstacle 1 to be avoided can be determined through the signal transferred from the sensor 214.

FIG. 15 is a view showing a robot 300 according to another embodiment of the present invention. In the following description, differences from the former embodiment would be explained.

In the robot 100 according to the former embodiment of the present invention, the front of the bumper plate 212 of the first bumper 210 and that of sensing plate 222 of the second bumper 220 are configured to come on the same line, according to which when the obstacle 1 to be avoided contacts therewith, the bumper plate 212 and the sensing plate 222 are simultaneously operated, and the obstacle 1 to be avoided can be determined through the signal transferred from the sensor 214.

Comparatively, however, in a robot 300 as shown in FIG. 15, the first bumper 210 is disposed to be protruded (i.e., to be ahead of the second bumper 220) compared with the second bumper 220. When the case 110 comes in contact with the obstacle 1 to be avoided, the obstacle 1 to be avoided first contacts with the first bumper 210 and then with the second bumper 220. Thus, before the second bumper 220 is operated, the obstacle 1 to be avoided can be determined.

In the embodiments as described above, the first bumper is configured to sense the obstacle 1 to be avoided, but alternatively, the robot may sense the obstacle 1 to be avoided by using radiowaves instead of through collision.

In addition, in the above-described embodiments, the second bumper is relatively rotated downwardly of the case. However, the present invention is not limited thereto, and without such a relative rotation, the second bumper may determine the surmountable obstacle while the case is moved in the facing direction, and help the robot pass over the surmountable obstacle. In this case, the structure of the second bumper can be simplified.

In addition, in the above-described embodiments, the second bumper determines the surmountable obstacle upon contacting with it, but the present invention is not limited thereto. The second bumper may determine the surmountable obstacle by using radiowaves, infrared rays, or the like. In addition, the robot may determine the surmountable obstacle based on signals from the first and second bumpers. Namely, as for the robot according to the present invention, not only does the second bumper discriminate the surmountable obstacle independently but also both the first and second bumpers can be used to discriminate the surmountable obstacle and the obstacle to be avoided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A robot comprising:

a case;

a first bumper coupled to the case, the first bumper being configured to sense an obstacle to be avoided; and a second bumper configured to sense a surmountable obstacle over which the robot is configured to pass, wherein the second bumper is configured to be relatively rotatable with respect to the case.

2. The robot of claim 1, wherein the second bumper is configured to sense the surmountable obstacle by contacting the surmountable obstacle.

3. The robot of claim 1, wherein the second bumper is configured to be relatively rotatable downwardly with respect to the case.

4. The robot of claim 1, wherein the second bumper is provided at a lower side of the first bumper.

5. The robot of claim 1, further comprising:

a driving wheel configured to move the robot, wherein the driving wheel is configured to pass over a height of the surmountable obstacle sensed by the second bumper.

6. The robot of claim 1, wherein the second bumper is configured to be relatively movable in forward and backward directions of the robot.

7. The robot of claim 1, wherein the second bumper comprises:

a sensing plate configured to be spaced from the case, wherein the sensing plate is configured to contact the surmountable obstacle;

an arm configured to protrude from the sensing plate toward the case;

a guide provided at the case, wherein the guide is configured to guide rotation and movement of the arm; and a sensor provided at the guide, wherein the sensor is configured to sense the surmountable obstacle via movement of the arm.

8. The robot of claim 7, wherein the sensing plate comprises:

a circumferential portion provided at a front of the case; and a bent portion coupled to the circumferential portion, wherein the bent portion is provided at a lower portion of the case.

9. The robot of claim 7, wherein the arm comprises:

a rod portion configured to protrude from the sensing plate in a direction of the guide; and a hinge portion configured to protrude in a direction in which the hinge portion crosses the rod portion, wherein the hinge portion is configured to be relatively movable and relatively rotatable with the guide.

10. The robot of claim 9, wherein the guide comprises:

a rod recess configured to allow insertion of the rod portion; and a hinge recess configured to allow insertion of the hinge portion, wherein the hinge recess is configured to guide a slidably movement of the hinge portion.

11. The robot of claim 10, wherein the hinge portion has a generally cylindrical shape.

12. The robot of claim 7, wherein the second bumper further comprises an elastic member provided between the arm and the guide, wherein the elastic member is configured to support the arm when the arm is moved.

13. The robot of claim 7, wherein the second bumper further comprises a return spring provided between the arm and the guide, wherein the return spring is configured to support the arm when the arm is rotated.

14. The robot of claim 1, wherein the first bumper is configured to be positioned in front of the second bumper.

15. The robot of claim 1, wherein the first bumper senses an obstacle to be avoided upon contacting the obstacle.

16. The robot of claim 1, further comprising:

a vacuum source coupled to the case; and an opening coupled to the vacuum source to suction debris as the robot moves.

17. A robot comprising:

a case;

a first bumper coupled to the case, wherein the first bumper is configured to sense an obstacle by contacting the obstacle; and a second bumper provided at a different height than that of the first bumper, wherein the second bumper is configured to sense an obstacle by contacting the obstacle, wherein an obstacle to be avoided and an obstacle to be passed over are determined based upon obstacle signals sensed by the first and second bumpers, wherein the second bumper is configured to be relatively rotatable with respect to the case.

18. A method for controlling a robot, comprising:

providing a case, coupling a first bumper to the case such that the first bumper is configured to sense an obstacle, and providing a second bumper such that the second bumper is configured to sense an obstacle; and determining that the robot is configured to pass over an obstacle when the first bumper does not sense an obstacle signal and the second bumper senses an obstacle signal, wherein the second bumper is configured to be relatively rotatable with respect to the case.

19. The method of controlling a robot according to claim 18, further comprising providing the second bumper at a lower side of the first bumper.

20. A robot comprising:

a case;

a first bumper coupled to the case;

a first sensor to detect contact with the first bumper;

a second bumper coupled to the case adjacent the first bumper;

a second sensor to detect contact with the second bumper, wherein:

(a) the first bumper is coupled to the case at a first height, (b) the second bumper is coupled to the case at a second height less than the first height, and (c) the first height is a height over which the robot is unable to pass when moved by a driver and the second height is height over which the robot passes when moved by the driver.

21. The robot of claim 20, further comprising:

a controller to send a signal to the driver to continue moving the robot when the second sensor outputs a detection signal and the first sensor does not output a detection signal.

22. The robot of claim 20, wherein the first height is at least three times the second height.

23. The robot of claim 20, wherein:

the first bumper moves in a first direction when contact is made when contact is made with the first bumper, and the second bumper moves in a second direction different from the first direction when contact is made with the second bumper, wherein the first bumper moves in a substantially linear direction and the second bumper moves in a rotational direction.

24. The robot of claim 20, wherein the second bumper rotates relative to the case when contact is made with the second bumper.

25. The robot of claim 20, further comprising:

a vacuum source coupled to the case; and an opening coupled to the vacuum source to suction debris wherein the driver includes:

a motor; and at least one wheel driven by the motor.

26. The robot of claim 20, wherein (1) the first bumper and the second bumper having front surfaces which lie in substantially a same plane or (2) a front surface of the first bumper is offset relative to a front surface of the second bumper such that the front surface of the first bumper extends a first distance from the case and the front surface of the second bumper extends a second distance from the case less than the first distance.

* * * * *